US008360148B2

(12) United States Patent
Atwood et al.

(10) Patent No.: US 8,360,148 B2
(45) Date of Patent: Jan. 29, 2013

(54) METHODS, APPARATUS AND ARTICLES OF MANUFACTURE TO MEASURE GAS RESERVOIR FORMATION PRESSURES

(75) Inventors: Keith Atwood, Katy, TX (US); Bobby Poe, Houston, TX (US); Casey R. Chadwick, Dallas, TX (US); Rajgopal V. Malpani, Houston, TX (US); Edward C. Boratko, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 284 days.

(21) Appl. No.: 12/581,403

(22) Filed: Oct. 19, 2009

(65) Prior Publication Data

US 2011/0088894 A1 Apr. 21, 2011

(51) Int. Cl.
*E21B 49/08* (2006.01)

(52) U.S. Cl. ..... 166/264; 166/250.01; 166/250.07; 166/100

(58) Field of Classification Search ..... 166/100, 166/250.01, 250.07, 264
See application file for complete search history.

(56) References Cited

U.S. PATENT DOCUMENTS 5,473,939 A * 12/1995 Leder et al. ..... 73/152.12
5,661,237 A 8/1997 Dussan V. et al.
2002/0176646 A1 11/2002 Wu et al.
2005/0269499 A1 12/2005 Jones et al.
2008/0307860 A1 12/2008 Guieze et al.
2008/0314138 A1 12/2008 Brady
2009/0038389 A1 * 2/2009 Zamfes ..... 73/152.04
2009/0167297 A1 7/2009 Chee et al.

OTHER PUBLICATIONS

"PS Platform, Production logging with confidence," Schlumberger, Sep. 1999, 6 pages.
"GHOST Gas Holdup Optical Sensor Tool, Shedding light on production logging," Schlumberger, Jul. 2001, 6 pages.
"PS Platform, Production logging with confidence," downloaded on Oct. 7, 2009, from http://www.slb.com/content/services/production/logging/ps_platform.asp, copyright 2009, Schlumberger, 1 page.
"GHOST," from http://www.slb.com/content/services/production/logging/ghost.asp, copyright 2009, Schlumberger, 1 page.

* cited by examiner

*Primary Examiner* — David Andrews
*Assistant Examiner* — Richard Alker
(74) *Attorney, Agent, or Firm* — John Vereb; Michael Flynn

(57) ABSTRACT

Example methods, apparatus and articles of manufacture to measure gas reservoir formation pressures are disclosed. A disclosed example method includes positioning a downhole bubble sensor in a wellbore formed in a geological gas reservoir formation, trapping a fluid in a portion of the wellbore including the bubble sensor, pressurizing the trapped fluid, reducing pressurization of the fluid until the bubble sensor detects one or more bubbles in the fluid, recording a pressure of the fluid when the bubble sensor detects the one or more bubbles, and determining a formation pressure of the gas reservoir from the recorded pressure.

19 Claims, 5 Drawing Sheets

METHODS, APPARATUS AND ARTICLES OF MANUFACTURE TO MEASURE GAS RESERVOIR FORMATION PRESSURES

BACKGROUND

Wellbores are drilled to, for example, locate and produce hydrocarbons. During a drilling operation, it may be desirable to perform evaluations of the formations penetrated and/or encountered formation fluids and/or gasses. In some cases, a drilling tool is removed and a wireline tool is then deployed into the wellbore to test and/or sample the formation, and/or gasses and fluids associated with the formation. In other cases, the drilling tool may be provided with devices to test and/or sample the surrounding formation, formation gasses and/or formation fluids without having to remove the drilling tool from the wellbore. These samples or tests may be used, for example, to characterize hydrocarbons extracted from the formation.

Figure 1:
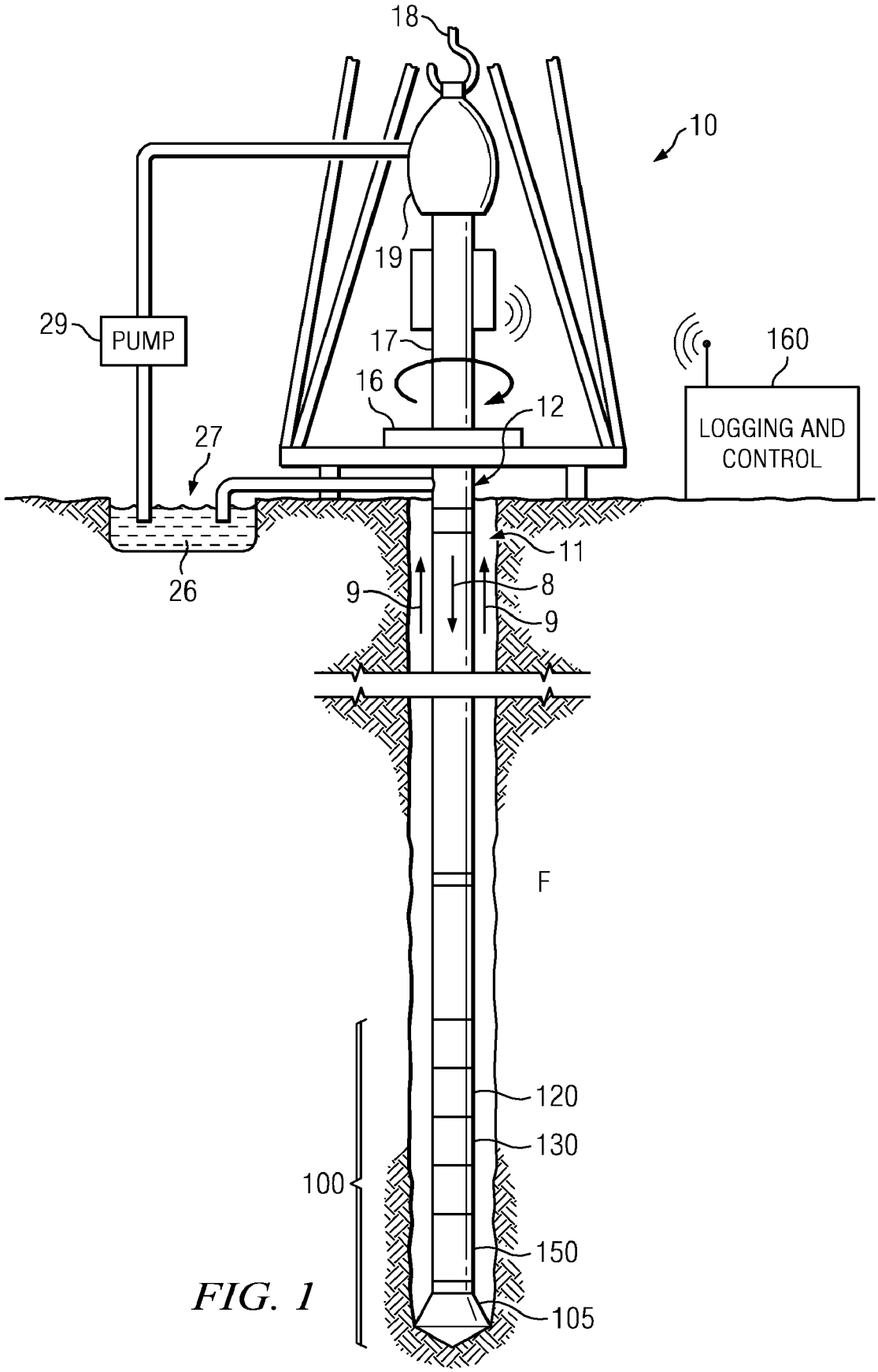
FIG. 1 depicts a partial cross-sectional view of an example wellsite drilling system including a downhole module according to one or more aspects of the present disclosure.

Certain examples are shown in the above-identified figures and described in detail below. In describing these examples, like or identical reference numbers may be used to identify common or similar elements. The figures are not necessarily to scale and certain features and certain views of the figures may be shown exaggerated in scale or in schematic for clarity and/or conciseness. Moreover, while certain preferred embodiments are disclosed herein, other embodiments may be utilized and structural changes may be made without departing from the scope of the invention.

DETAILED DESCRIPTION

The permeability of shale gas reservoirs is typically very low (e.g., 100 to 300 nano Darcies). Obtaining formation pressures for such gas reservoirs using conventional techniques may be difficult, costly, risky and/or very time consuming, and no one method has been proven to deliver accurate results. However, formation pressures are important when determining reserves and/or decline rates for shale reservoirs. For low permeability formations, a conventional wireline formation test would have to stay in place for a minimum of several hours and may not obtain useable results. The risks of the downhole tool becoming stuck in the wellbore or the loss of the downhole tool are substantial while the potential for accurate formation pressure determination is low. Additionally or alternatively, an injection fall off test could be performed to measure reservoir pressures. However, the gauges required to perform such a test would have to be left in place for several weeks, and the height of the rock treated during the pump-in can only be estimated.

Example methods, apparatus and articles of manufacture that may be used to determine gas reservoir formation pressures and overcome at least these deficiencies are disclosed. Disclosed examples may utilize one or more sensors that can detect very low levels of gas present in liquids. A fluid contained, trapped and/or otherwise held in a portion of a wellbore may be pressurized above the expected gas reservoir formation pressure. While the pressure of the trapped fluid is systematically reduced, an output of a sensor may be monitored to determine, identify and/or detect when gas bubbles first begin to appear in the liquid. The pressure at which the gas bubbles first begin to appear may be used to determine the formation pressure. The pressure of the fluid may be reduced continuously or in steps. If the pressure is reduced in steps, the formation pressure may be determined to an accuracy defined by size of the pressure reduction steps. An example sensor is an optical sensor that may be used to detect gas in liquids by measuring an amount of reflected light at the sensor point. Because bubbles reflect light differently than liquid, a change in the amount of reflected light may be representative of the presence of bubbles in the liquid. Another example sensor that may be used to detect gas in liquids detects bubbles by detecting a change in resistivity of the trapped fluid at the sensor point that may be caused by the presence of the bubbles.

While examples are described herein with reference to particular while-drilling, coiled tubing and/or wireline conveyed tools, it should be understood that such examples are merely illustrative and other embodiments may be implemented without departing from the scope of this disclosure. For example, the example LWD modules 120 of FIGS. 2 and 3 may be implemented by and/or within a wireline assembly and/or wireline tool. Likewise, the example wireline tool 402 of FIG. 4 may be implemented by and/or within a while-drilling tool or drillstring.

FIG. 1 illustrates an example wellsite drilling system that can be employed onshore and/or offshore. In the example wellsite system of FIG. 1, a borehole 11 is formed in one or more subsurface formations F by rotary and/or directional drilling. In the illustrated example of FIG. 1, a drillstring 12 is suspended within the borehole 11 and has a bottom hole assembly (BHA) 100 having a drill bit 105 at its lower end. A surface system includes a platform and derrick assembly 10 positioned over the borehole 11. The assembly 10 includes a rotary table 16, a kelly 17, a hook 18 and a rotary swivel 19. The drillstring 12 is rotated by the rotary table 16, energized by means not shown, which engages the kelly 17 at the upper end of the drillstring 12. The example drillstring 12 is suspended from the hook 18, which is attached to a traveling block (not shown), and through the kelly 17 and the rotary swivel 19, which permits rotation of the drillstring 12 relative to the hook 18. Additionally or alternatively, a top drive system could be used.

In the example of FIG. 1, the surface system further includes drilling fluid 26, which is commonly referred to in the industry as mud, stored in a pit 27 formed at the well site. A pump 29 delivers the drilling fluid 26 to the interior of the drillstring 12 via a port (not shown) in the swivel 19, causing the drilling fluid to flow downwardly through the drillstring 12 as indicated by the directional arrow 8. The drilling fluid 26 exits the drillstring 12 via ports in the drill bit 105, and then circulates upwardly through the annulus region between the outside of the drillstring 12 and the wall of the borehole, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example BHA 100 of FIG. 1 includes, among other things, any number and/or type(s) of downhole tools, such as logging-while-drilling (LWD) module 120 and/or a measuring-while-drilling (MWD) module 130, a rotary-steerable system or mud motor 150, and the example drill bit 105.

As described below in connection with FIGS. 2 and 3, the example LWD module 120 of FIG. 1 may include one or more sensors that can detect gas bubbles that are present in a liquid. Outputs of the sensor(s) may be used and/or monitored to determine gas reservoir formation pressures. The example LWD module 120 is housed in a special type of drill collar, as it is known in the art, and may contain any number of additional logging tools, fluid analysis devices, formation evaluation modules, and/or fluid sampling devices. The example LWD module 120 may include capabilities for measuring, processing, and/or storing information, as well as for communicating with the MWD module 130 and/or directly with surface equipment, such as a logging and control computer 160.

The example MWD module 130 of FIG. 1 is also housed in a special type of drill collar and contains one or more devices for measuring characteristics of the drillstring 12 and/or the drill bit 105. The example MWD tool 130 further includes an apparatus (not shown) for generating electrical power for use by the downhole system 100. Example devices to generate electrical power include, but are not limited to, a mud turbine generator powered by the flow of the drilling fluid, and a battery system. Example measuring devices include, but are not limited to, a weight-on-bit measuring device, a torque measuring device, a vibration measuring device, a shock measuring device, a stick slip measuring device, a direction measuring device, and an inclination measuring device. The MWD module 130 also includes capabilities for communicating with surface equipment, such as the logging and control computer 160, using any past, present or future two-way telemetry system such as a mud-pulse telemetry system, a wired drill pipe telemetry system, an electromagnetic telemetry system and/or an acoustic telemetry system.

Figure 2:
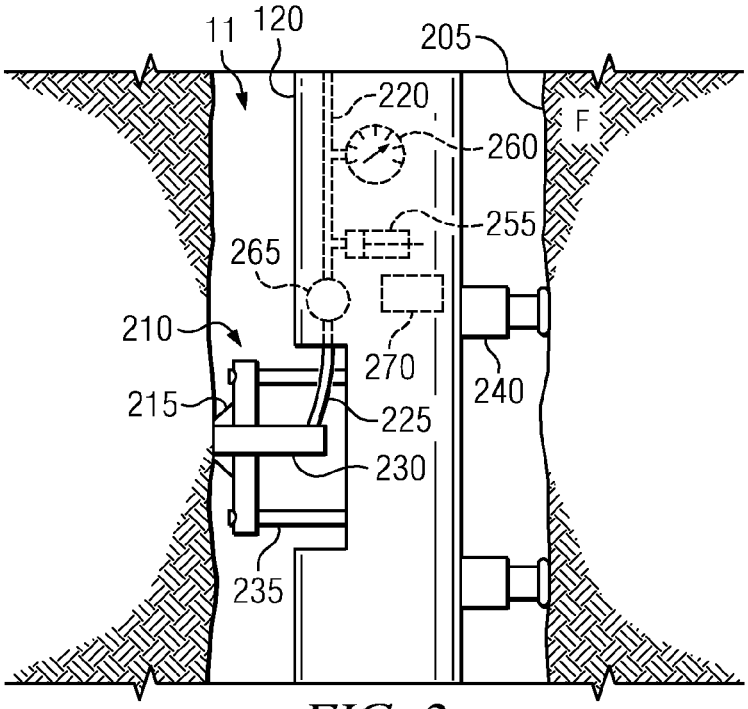
FIGS. 2 and 3 depict example downhole modules according to one or more aspects of the present disclosure.

FIG. 2 illustrates an example manner of implementing the example LWD module 120 of FIG. 1. The example LWD module 120 of FIG. 2 is positioned in the example wellbore 11 of FIG. 1. To seal the example LWD module 120 of FIG. 2 against a wall 205 of the wellbore 11, the example LWD module 120 may include a probe assembly 210. The example probe assembly 210 of FIG. 2 may include a packer 215 that may seal the probe assembly 210 to the wall 205, thereby fluidly coupling a flowline 220 of the LWD module 120 to the formation F.

As shown in FIG. 2, the example interval boundary and/or packer 215 isolates, creates and/or defines a particular portion of the wellbore 11 in which a fluid, such as a drilling mud or formation fluid, may be trapped, contained and/or captured. The example flowline 220 of FIG. 2 may include a flexible and/or articulated portion 225 to allow the flowline 220 to extend together with the probe assembly 210. The flowline 220 may include a filter 230 to prevent particles and/or debris from entering the LWD module 120. The example flowline 220 of FIG. 2 may be oriented so that any bubbles present in the flowline 220 may move from the probe assembly 210 toward a sensor 265. Probe pistons (one of which is designated at reference numeral 235) and backup pistons (one of which is designated at reference numeral 240) may assist in pushing and/or sealing the example packer 215 against the wellbore wall 205.

To control the pressure of the fluid in the flowline 220, the example LWD module 120 of FIG. 2 may include any type of pressurization module 255 and any type of pressure gauge 260. The example pressurization module 255 of FIG. 2 may be a piston that may be positioned and/or controlled to increase and decrease the pressure of the fluid in the flowline 220, which is fluidly coupled to the formation F via the probe assembly 210. When the pressurization module 255 is controlled to pressurize the fluid in the flowline 220 to a pressure exceeding the formation pressure of the formation F, then any gas present in the formation F may be prevented from moving, flowing and/or migrating into the flowline 220 via the probe assembly 210. On the other hand, when the pressurization module 255 is controlled to pressurize the fluid in the flowline 220 to a pressure at and/or below the formation pressure of the formation F, then gas from the formation F may enter the flowline 220 via the probe assembly 210. The example pressure gauge 260 may be used to measure the current pressure of the fluid in flowline 220.

To sense the presence of gas in the fluid in the flowline 220, the example LWD module 120 of FIG. 2 includes one or more bubble sensors, one of which is designated at reference numeral 265. The example bubble sensor 265 of FIG. 2 may have an electrical output signal that represents whether gas bubbles are present. An example bubble sensor 265 is an optical sensor that uses optical properties (e.g., refractive index) to distinguish gases from liquid. The example bubble sensor 265 may include a light emitting diode (LED) to create light that may be guided via an optical fiber to a needle-sized probe manufactured from, for example, sapphire. When the light reaches the tip of the probe, some of the light may be transmitted into and/or through the fluid in the flowline 220, while the remaining light may be reflected and travel back along the optical fiber. The reflected light may be directed via a "y" coupler to a receiving photodiode that may convert the reflected light into an electrical signal. The value of the electrical signal may be proportional to the amount and/or intensity of the reflected light. The amount and/or intensity of the reflected light may depend on the refractive index of the medium (e.g., gas versus liquid) and the shape of the probe. The size and geometry of the example probe may be selected so that the amount of light reflected by a gas is substantially different from the amount of light reflected by a liquid. In a disclosed example, nearly 100% of the transmitted light is reflected by a gas, while less than 40% of the light is reflected by a liquid. Because the amount of reflected light is so different for a gas than for a liquid, the electrical signal output by the receiving photodiode may be readily used to distinguish liquids and gasses. By, for example, comparing the electrical signal to a threshold, the presence of bubbles in a fluid may be readily detected and, in fact, the number of bubbles may be counted.

Example optical sensors to detect gas in a liquid are described in U.S. Patent Publication No. 2005/0269499, entitled "Method and Sensor for Monitoring Gas In A Downhole Environment," and published Dec. 8, 2005; U.S. Patent Publication No. 2009/0167297, entitled "Optical Fiber System and Method For Wellhole Sensing of Fluid Flow Using Diffraction Effect of Faraday Crystal," and published Jul. 2, 2009; U.S. Patent Publication No. 2008/0314138, entitled "Optical Wellbore Fluid Characterization Sensor," and published Dec. 25, 2008; U.S. Patent Publication No. 2008/0307860, entitled "Detector For Distinguishing Phases In A Multiphase Fluid Mixture," and published Dec. 18, 2008; U.S. Patent Publication No. 2002/0176646, entitled "Optical Probes and Probe Systems For Monitoring Fluid Flow In A Well," and published Nov. 28, 2002, all of which are hereby incorporated by reference in their entirety, and all of which are assigned to the assignee of this disclosure.

An additional and/or alternative example sensor 265 that measures the resistivity of the fluid in the flowline 220 may be used to distinguish gases and liquids. The example resistivity sensor 265 may include a pair of electrodes spaced apart by a distance that may be smaller than the smallest bubble to be detected. A current may be passed between the pair of electrodes to measure a resistivity between the electrodes. Because the measured resistivity may vary based on whether liquid or a gas bubble is between the electrodes, an output of the sensor may be used to readily distinguish gas from liquid. Example methods and apparatus to implement a resistivity sensor to detect gas bubbles in a liquid are described in U.S. Pat. No. 5,661,237, entitled "Method and Apparatus For Locally Measuring Flow Parameters of a Multiphase Fluid," and granted Aug. 26, 1997, which is hereby incorporated by reference in its entirety, and which is assigned to the assignee of this disclosure.

To determine the formation pressure of the formation F, the example LWD module 120 of FIG. 2 may include a formation pressure identifier 270. The example formation pressure identifier 270 may systematically control the example pressurization module 255 to adjust the pressure of the fluid in the flowline 220 while monitoring the electrical output signal of the sensor 265 to determine whether bubbles are present. The formation pressure identifier 270 may start with a fluid pressure that is expected to exceed the formation pressure and may systematically decrease the fluid pressure over a period of time until the sensor 265 detects bubbles. Because the fluid pressure at which bubbles are initially detected corresponds to the formation pressure, the formation pressure identifier 270 may record the current fluid pressure obtained from the pressure gauge 260 as the formation pressure. If the fluid pressure is adjusted in discrete steps, then the formation pressure may be between the current pressure and the previous fluid pressure. The fluid pressure reduction step size may be selected using any number of criteria such as range of pressures to test, allotted test time, a priori knowledge of formation pressure, etc.

In some examples, the formation pressure identifier 270 may control the pressurization module 255 to re-pressurize the fluid in the flowline 220 at the previous fluid pressure and gradually decrease the fluid pressure from that pressure using a smaller step size to obtain a more accurate estimate and/or measurement of the formation pressure.

The example formation pressure identifier 270 may refine and/or adjust the formation pressure measured as described above by performing and/or implementing any number and/or type(s) of additional tests such as a step down test, a selected inflow performance test, a multi-rate test, and/or a limited inflow potential test. However, such additional tests need not be performed.

Figure 3:
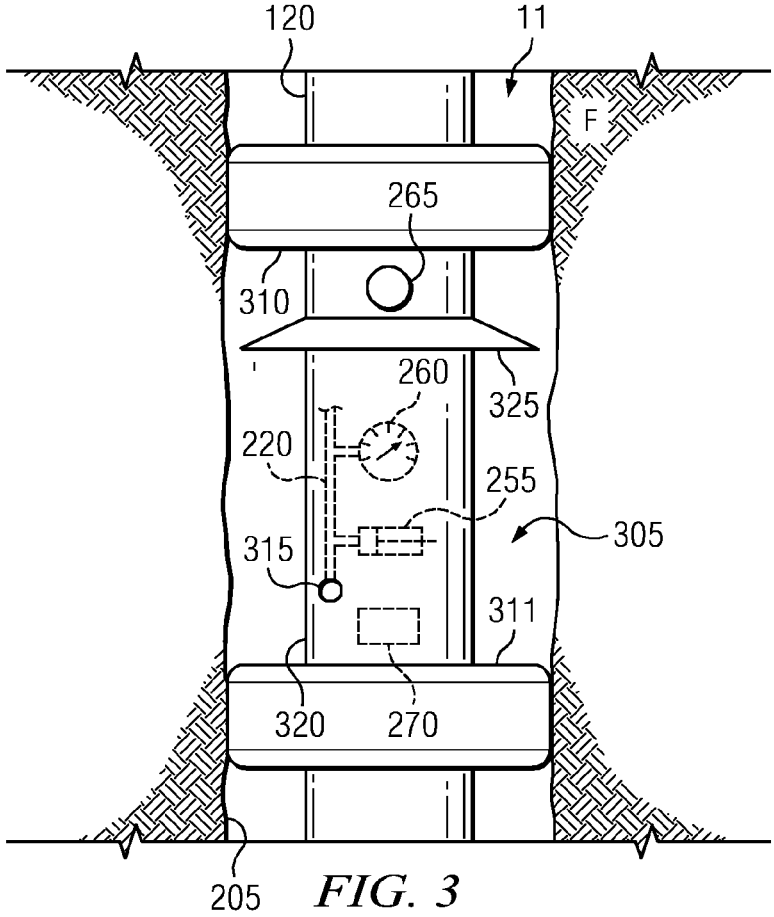

FIG. 3 illustrates another example manner of implementing the example LWD module 120 of FIG. 1. Because some elements of the example LWD module 120 of FIG. 3 are identical to those discussed above in connection with FIG. 2, the description of identical elements is not repeated here. Instead, identical elements are illustrated with identical reference numerals in FIGS. 2 and 3, and the interested reader is referred back to the descriptions presented above in connection with FIG. 2 for a complete description of those like-numbered elements.

To define a portion and/or interval 305 of the wellbore 11, the example LWD module 120 of FIG. 3 includes packers 310 and 311. The example packers 310 and 311 of FIG. 3 may have an annular shape and may be inflated to seal against the wellbore wall 205. When the interval boundaries and/or packers 310 and 311 are inflated, the portion 305 of the wellbore 11 may be fluidly separated from other portions of the wellbore 11. Before initiating determination of the formation pressure, the example formation pressure identifier 270 may inflate the packers 310 and 311.

To fluidly couple the example flowline 220 to the interval 305 defined by the packers 310 and 311, the example LWD module 120 of FIG. 3 may include a port 315. The example pressurization module 255 of FIG. 3 may adjust the pressure of the fluid in the interval 305 via the example port 315.

To expose the example sensor 265 to fluid and/or gas bubbles in the interval 305, the example sensor 265 of FIG. 3 may be implemented outside of a housing 320 of the example LWD module 120. To direct bubbles in the fluid inside the interval 305 toward the sensor 265, the example LWD module 120 of FIG. 3 may include a funnel 325. As shown in FIG. 3, the example sensor 265 may be mounted at the narrow end of the example funnel 325. When the fluid pressure inside the interval 305 drops below the formation pressure of the formation F, bubbles may form on the borehole wall 205. As the bubbles move toward the packer 310 within the interval 305, the example funnel 325 may concentrate and direct the bubbles toward the sensor 265.

While example manners of implementing the example LWD module 120 of FIG. 1 have been illustrated in FIGS. 2 and 3, one or more of the elements, sensors, circuits, modules, processes and/or devices illustrated in FIGS. 2 and/or 3 may be combined, divided, re-arranged, omitted, eliminated and/or implemented in any other way. For example, while the illustrated examples of FIGS. 2 and 3 depict everything as implemented by one LWD module 120, one or more of the elements depicted as being implemented by the example LWD module 120 may be implemented by one or more other modules of the drillstring 12. For example, the pressurization module 255 may be implemented in another drillstring module. Further, the example pressurization module 255, the example pressure gauge 260, the example sensor 265, the example formation pressure identifier 270 and/or, more generally, the example LWD module 120 of FIGS. 1-3 may be implemented by hardware, software, firmware and/or any combination of hardware, software and/or firmware. Thus, for example, any or all of the example pressurization module 255, the example pressure gauge 260, the example sensor 265, the example formation pressure identifier 270 and/or, more generally, the example LWD module 120 may be implemented by one or more circuit(s), programmable processor (s), application specific integrated circuit(s) (ASIC(s)), programmable logic device(s) (PLD(s)), field-programmable logic device(s) (FPLD(s)), field-programmable gate array(s) (FPGA(s)), etc. The LWD module 120 may include elements, sensors, circuits, modules, processes and/or devices instead of, or in addition to, those illustrated in FIGS. 2 and 3, and/or may include more than one of any or all of the illustrated elements, sensors, circuits, modules, processes and/or devices. For example, the LWD module 120 may include an analog-to-digital converter (ADC) to convert the electrical signal output of the example sensor 265 into a stream of digital samples that may be digitally processed by the example formation pressure identifier 270 to determine formation pressures.

Figure 4:
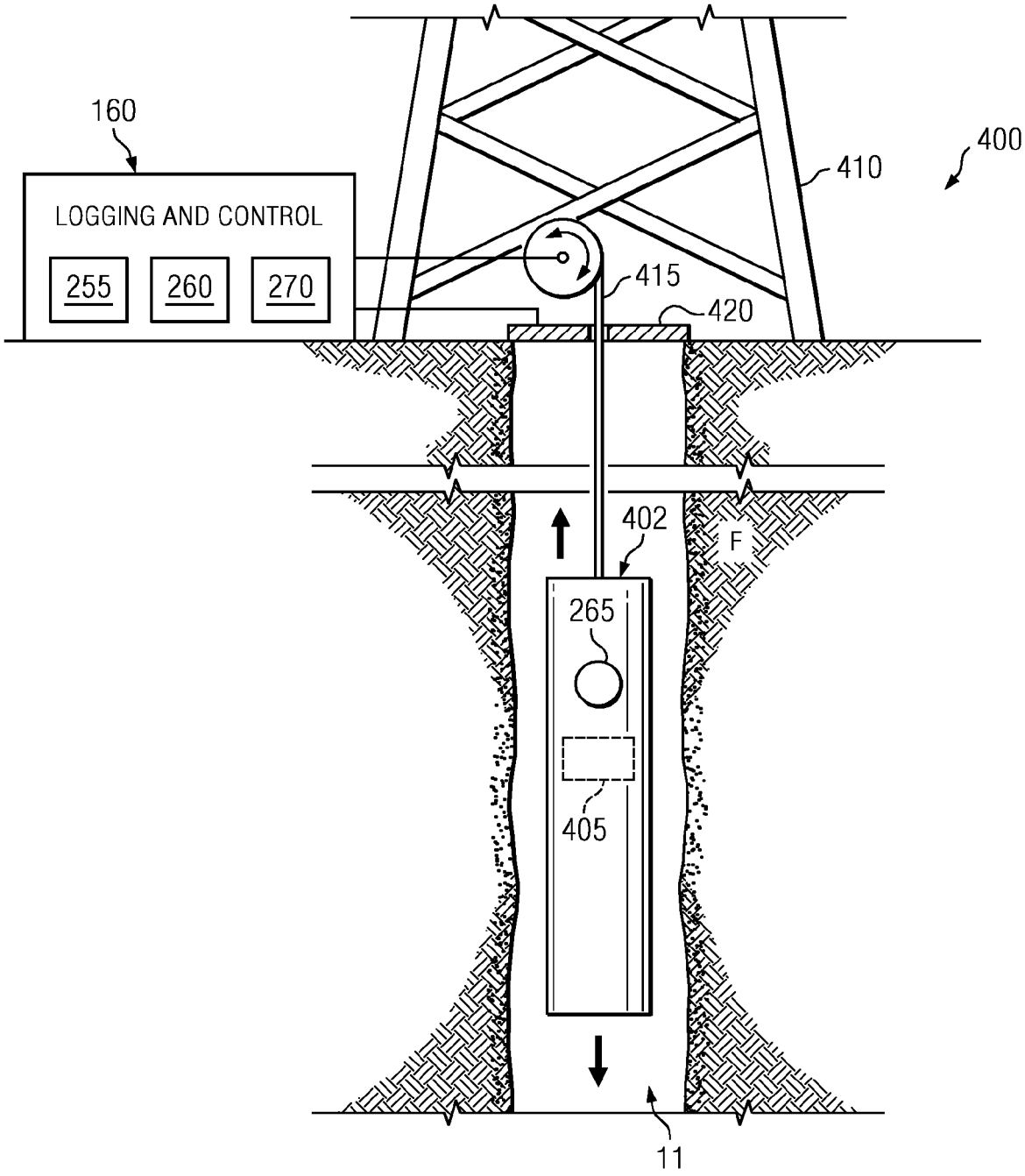
FIG. 4 depicts a partial cross-sectional view of an example wellsite wireline formation evaluation system according to one or more aspects of the present disclosure.

FIG. 4 shows a schematic, partial cross-sectional view of an example formation pressure testing system 400 that may be used to determine gas reservoir formation pressures. Because some elements of the example formation pressure testing system 400 of FIG. 4 are identical to those discussed above in connection with FIGS. 1-3, the description of identical elements is not repeated here. Instead, identical elements are illustrated with identical reference numerals in FIGS. 1-4, and the interested reader is referred back to the descriptions presented above in connection with FIGS. 1-3 for a complete description of those like-numbered elements.

In contrast to the examples described above in connection with FIGS. 1-3, in the illustrated example of FIG. 4, the example pressurization module 255, the example pressure gauge 260 and the formation pressure identifier 270 may implemented by the example logging and control system 160 at a surface location rather than in a downhole wireline tool 402. Additionally or alternatively, the example pressure gauge 260 may be implemented by the example wireline tool 402, and the logging and control system 160 may obtain, read and/or access outputs of the downhole pressure gauge 260 via telemetry. As the wireline tool 402 operates, outputs of the example sensor 265 may be sent via, for example, telemetry to the logging and control computer 160 and/or may be stored in any number and/or type(s) of memory(-ies) 405 for subsequent recall and/or processing to determine formation pressure(s). Example wireline tools 402 that include a sensor 265 capable to detect gas bubbles in a liquid include, but are not limited to, the Schlumberger GHOST™ Optical Sensor Tool and the Schlumberger DEFT™ (Digital Entry and Fluid Imager) Tool.

The example wireline tool 402 of FIG. 4 is suspended from a rig 410 in the wellbore 11 formed in the geologic formation F. The example wireline tool 402 of FIG. 4 m deployed from the rig 410 into the wellbore 11 via a wireline cable 415 and may be positioned within and/or moved through any particular portion of the geologic formation F. The portion(s) of the wellbore 11 to be tested may have been perforated using any number and/or type(s) of method(s), such as explosive charges.

To seal the wellbore 11 to enable formation pressure determination, the example system 400 of FIG. 4 includes any type of wellbore seal and/or cap 420. When the wellbore 11 is sealed with the interval boundary, seal and/or cap 420, a formation pressure test interval comprising substantially all of the wellbore 11 may be formed. Because the volume of fluid in the wellbore 11 is substantially larger than the fluid trapped in the example flowline 220 and/or example interval 305 of FIGS. 2 and 3, the example pressurization module 255 of FIG. 4 may comprise a motorized pump.

To determine the formation pressure of the formation F, the example formation pressure identifier 270 of FIG. 4 may control the example pressurization module 255 to adjust the pressure of the fluid in the wellbore 11 to a pressure exceeding an expected formation pressure of the formation F. The logging and control computer 160 may position the wireline tool 402 above a portion of the formation F to be tested. A logging pass of the portion of the formation F to be tested may then be carried out by moving the wireline tool 402 through that portion and recording outputs of the sensor 265 as the wireline tool 402 moves. The formation pressure identifier 270 may then control the pressurization module 255 to reduce the fluid pressure in the wellbore 11 by, for example, 25 pounds per square inch, and another logging pass with the wireline tool 402 may be carried out. This process may be repeated until outputs of the sensor 265 indicate that gas bubbles in the fluid in the wellbore have been detected.

Because the fluid pressure at which bubbles are initially detected substantially corresponds to the formation pressure, the formation pressure identifier 270 may obtain the current fluid pressure from the pressure gauge 260 and may record the obtained fluid pressure as the formation pressure. If the fluid pressure is adjusted in discrete steps, then the formation pressure is between the current pressure and the previous fluid pressure. In some examples, the formation pressure identifier 270 may control the pressurization module 255 to re-pressurize the fluid in the wellbore 11 at the previous fluid pressure, and may then gradually decrease the fluid pressure from that pressure using a smaller step size to obtain a more accurate estimate and/or measurement of the formation pressure.

The example formation pressure identifier 270 of FIG. 4 may refine and/or adjust the formation pressure identified as described above by performing and/or implementing any number and/or type(s) of additional tests such as a step down test, a selected inflow performance test, a multi-rate test, and/or a limited inflow potential test. However, such additional tests need not be performed.

Because the example wireline tool 402 is moved within the wellbore 11 during a logging pass, a sequence of outputs of the example sensor 265 may be processed and/or analyzed to determine formation pressures at different locations in the formation F.

While example wireline formation evaluation system 400 is shown in FIG. 4, one or more of the elements, sensors, circuits, modules, processes and/or devices illustrated in FIG. 4 may be combined, divided, re-arranged, omitted, eliminated and/or implemented in any other way. Further, the example pressurization module 255, the example pressure gauge 260, the example sensor 265, the example formation pressure identifier 270, the example logging and control computer 160 and/or the example wireline tool 402 of FIG. 4 may be implemented by hardware, software, firmware and/or any combination of hardware, software and/or firmware. Thus, for example, any or all of the example pressurization module 255, the example pressure gauge 260, the example sensor 265, the example formation pressure identifier 270, the example logging and control computer 160 and/or the example wireline tool 402 may be implemented by one or more circuit(s), programmable processor(s), ASIC(s), PLD (s), FPLD(s), FPGA(s), etc. The wireline formation evaluation system 400 may include elements, sensors, circuits, modules, processes and/or devices instead of, or in addition to, those illustrated in FIG. 4, and/or may include more than one of any or all of the illustrated elements, sensors, circuits, modules, processes and/or devices. For example, the wireline tool 402 may include an ADC to convert the electrical signal output of the example sensor 265 into a stream of digital samples that may be digitally processed by the example formation pressure identifier 270 to determine formation pressures.

Figure 5:
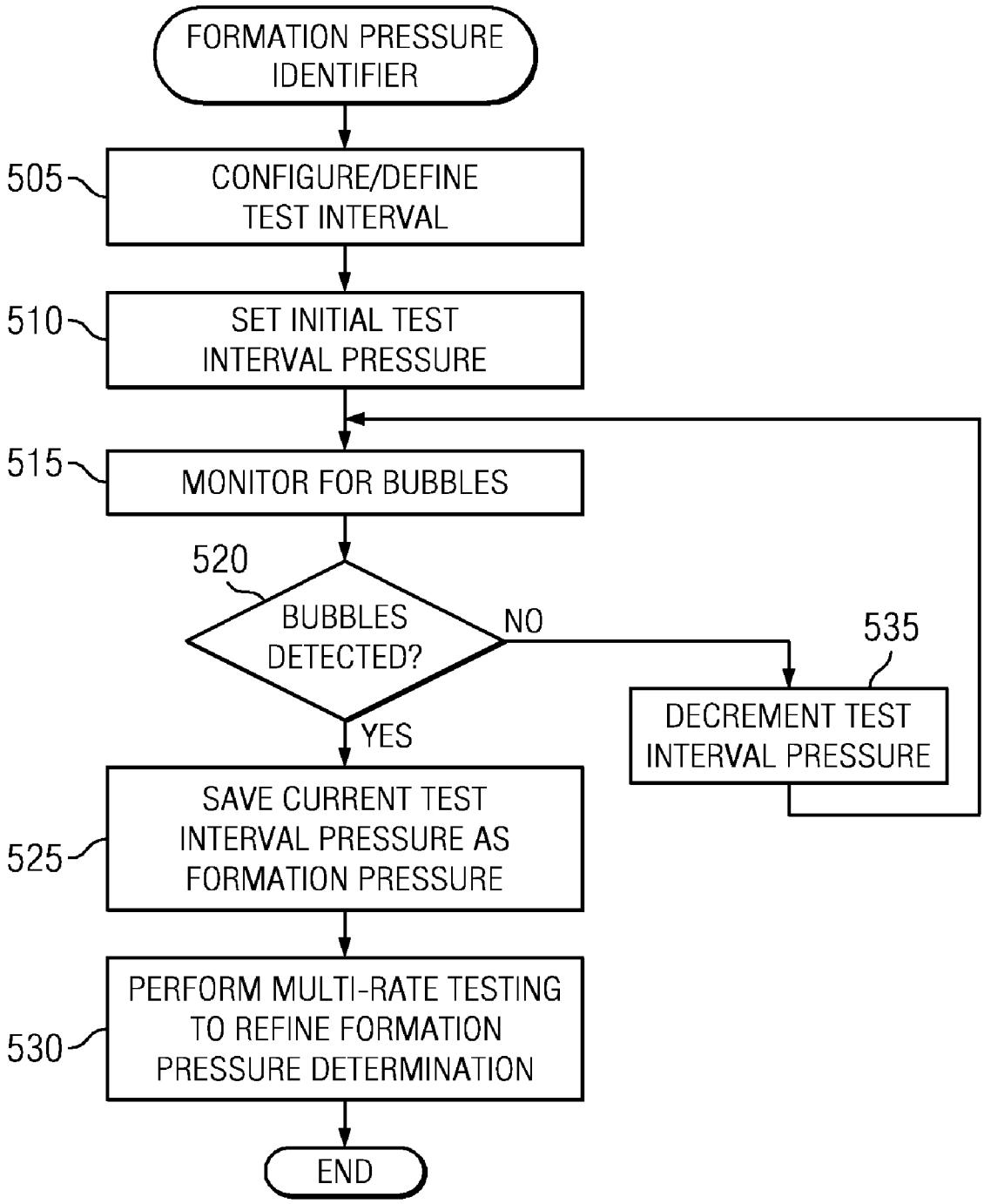
FIG. 5 depicts an example process according to one or more aspects of the present disclosure.

FIG. 5 is a flowchart representative of an example process that may be carried out to implement any number and/or type(s) of wireline tool(s) and/or while-drilling tool(s), such as the example downhole tools 120 and 402 of FIGS. 1-4. The example process of FIG. 5 may be carried out by a processor, a controller and/or any other suitable processing device. For example, the example process of FIG. 5 may be embodied in coded instructions stored on an article of manufacture such as any tangible computer-readable and/or computer-accessible media. Example tangible computer-readable medium include, but are not limited to, a flash memory, a compact disc (CD), a digital versatile disc (DVD), a floppy disk, a read-only memory (ROM), a random-access memory (RAM), a programmable ROM (PROM), an electronically-programmable ROM (EPROM), and/or an electronically-erasable PROM (EEPROM), an optical storage disk, an optical storage device, magnetic storage disk, a magnetic storage device, and/or any other tangible medium which can be used to store and/or carry program code and/or instructions in the form of machine-accessible and/or machine-readable instructions or data structures, and which can be accessed by a processor, a general-purpose or special-purpose computer, or other machine with a processor (e.g., the example processor platform P100 discussed below in connection with FIG. 6). Combinations of the above are also included within the scope of computer-readable media. Machine-readable instructions comprise, for example, instructions and/or data that cause a processor, a general-purpose computer, special-purpose computer, or a special-purpose processing machine to implement one or more particular processes. Alternatively, some or all of the example process of FIG. 5 may be implemented using any combination(s) of ASIC(s), PLD(s), FPLD(s), FPGA(s), discrete logic, hardware, firmware, etc. Also, some or all of the example process of FIG. 5 may instead be implemented manually or as any combination of any of the foregoing techniques, for example, any combination of firmware, software, discrete logic and/or hardware. Further, many other methods of implementing the example operations of FIG. 5 may be employed. For example, the order of execution of the blocks may be changed, and/or one or more of the blocks described may be changed, eliminated, sub-divided, or combined. Additionally, any or all of the example process of FIG. 5 may be carried out sequentially and/or carried out in parallel by, for example, separate processing threads, processors, devices, discrete logic, circuits, etc.

The example process of FIG. 5 begins with an interval and/or portion of the example wellbore 11 being defined (block 505). For example, the example probe assembly 210 may be pressed against the wellbore wall 205, the example packers 310 and 311 inflated, and/or the example wellbore cap and/or seal 420 established.

The example formation pressure identifier 270 may control the example pressurization module 255 to establish a first fluid pressure in the defined portion of the wellbore 11 (block 510). The first fluid pressure may be selected to be greater than an expected formation pressure. The formation pressure identifier 270 may monitor the output(s) of the example sensor 265 to determine whether bubbles are present in the pressurized fluid (block 515).

If bubbles are detected (block 520), the current fluid pressure may be obtained from the example pressure gauge 260 and recorded as the formation pressure and/or an estimate of the formation pressure (block 525). In the example of FIG. 5, the example formation pressure identifier 270 may refine and/or adjust the formation pressure identified as described above by performing and/or implementing any number and/or type(s) of additional tests, such as, a step down test, a selected inflow performance test, a multi-rate test, and/or a limited inflow potential test (block 530). However, such additional tests need not be performed. Control then exits from the example process of FIG. 5.

Returning to block 520, if bubbles were not detected (block 520), the fluid pressure may be reduced (block 535) and control returns to block 515 to monitor for bubbles.

Figure 6:
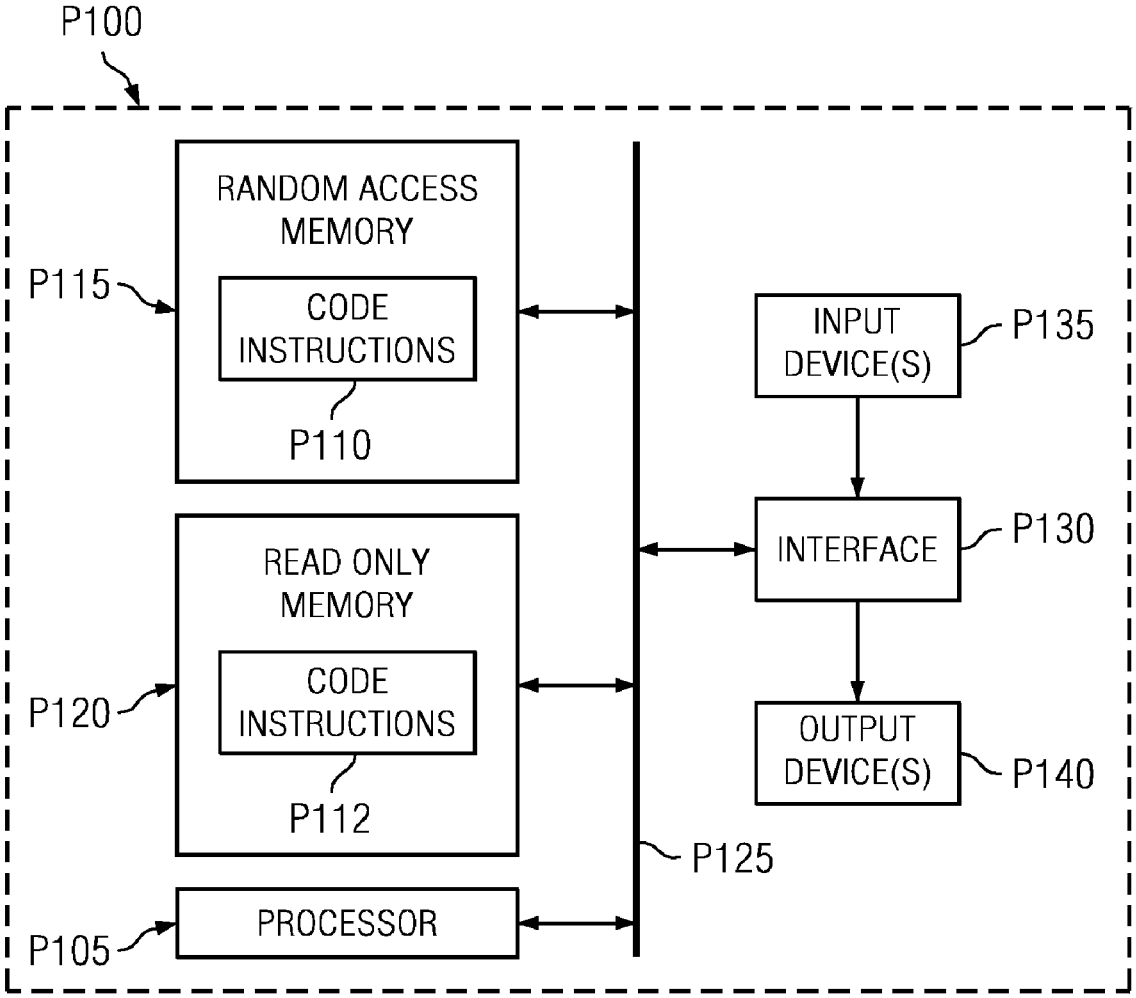
FIG. 6 depicts an example processor platform that may be used and/or programmed to implement one or more aspects of the present disclosure.

FIG. 6 is a schematic diagram of an example processor platform P100 that may be used and/or programmed to implement the example downhole tools and/or modules 120 and 420 of FIGS. 1-4 and/or the example process of FIG. 5. For example, the processor platform P100 can be implemented by one or more general-purpose processors, processor cores, microcontrollers, etc.

The processor platform P100 of the example of FIG. 6 includes at least one general-purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may carry out, among other things, the example process of FIG. 5 to measure gas reservoir formation pressures.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown). The memory P115, P120 may be used to implement the example storage 405 of FIG. 4.

The processor platform P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example output device P140 may be used to, for example, control the example pressurization module 255 and/or transmit outputs of the sensor 265 from the example wireline tool 402 to the example logging and control computer 160. The example input device P135 may be used to, for example, receive outputs of the example sensor 265 and/or obtain pressure readings from the example pressure gauge 260.

In view of the foregoing description and the figures, it should be clear that the present disclosure introduces a method of positioning a downhole bubble sensor in a wellbore formed in a geological gas reservoir formation, trapping a fluid in a portion of the wellbore including the bubble sensor, pressurizing the trapped fluid, reducing pressurization of the fluid until the bubble sensor detects one or more bubbles in the fluid, recording a pressure of the fluid when the bubble sensor detects the one or more bubbles, and determining a formation pressure of the gas reservoir from the recorded pressure.

The present disclosure also introduces an apparatus including a downhole tool including a sensor to detect bubbles in a fluid, an interval boundary to trap the fluid in a portion of a wellbore in a geological gas reservoir, a pressurization module to pressurize the fluid, and to sequentially reduce pressurization of the fluid, and a formation pressure identifier to, when the sensor detects the bubbles in the fluid during the sequential reduced pressurization of the fluid, record a pressure of the fluid when the sensor detects the bubbles, and to determine a formation pressure from the recorded pressure.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method, comprising:

positioning a downhole bubble sensor in a wellbore formed in a geological gas reservoir formation;

trapping a fluid in a portion of the wellbore including the bubble sensor;

pressurizing the trapped fluid;

reducing pressurization of the fluid until the bubble sensor detects one or more bubbles in the fluid;

recording a pressure of the fluid when the bubble sensor detects the one or more bubbles; and determining a formation pressure of the gas reservoir from the recorded pressure wherein the sensor is configured to detect the bubbles in the fluid by measuring a change in resistivity.

2. The method of claim 1 wherein reducing pressurization of the fluid until the bubble sensor detects the one or more bubbles comprises:

reducing the pressure of the fluid from a second pressure to a third pressure;

determining whether the bubble sensor detected the one or more bubbles at the third pressure; and when the bubble sensor did not detect the one or more bubbles at the third pressure, further reducing pressurization of the fluid to the recorded pressure.

3. The method of claim further comprising:

performing a first wireline logging pass at the third pressure to determine whether the bubble sensor detects the one or more bubbles at the third pressure; and performing a second wireline logging pass at the recorded pressure to determine whether the bubble sensor detects the one or more bubbles at the recorded pressure.

4. The method of claim 1 wherein the portion of the wellbore comprises substantially all of the wellbore, and further comprising sealing the wellbore at a surface location to trap the fluid in the wellbore.

5. The method of claim 1 further comprising inflating annular packers of a downhole tool to define the portion of the wellbore around the downhole tool, wherein the downhole tool includes the bubble sensor.

6. The method of claim further comprising sealing a fluid sampling probe of a downhole tool against a wall of the wellbore to define the portion of the wellbore, wherein the downhole tool includes the bubble sensor.

7. The method of claim 1 further comprising performing at least one of a step down test, a selected inflow performance test, a multi-rate test, or a limited inflow potential test to determine the formation pressure from the recorded pressure.

8. The method of claim 1 further comprising controlling a pump at a surface location to pressurize and reduce pressurization of the fluid.

9. The method of claim 1 further comprising controlling a piston of a downhole tool to pressurize and reduce pressurization of the fluid, wherein the downhole tool includes the bubble sensor.

10. An apparatus, comprising:

a downhole tool including a sensor configured to detect bubbles in a fluid;

an interval boundary configured to trap the fluid in a portion of a wellbore in a geological gas reservoir;

a pressurization module configured to pressurize the fluid, and to sequentially reduce pressurization of the fluid; and a formation pressure identifier configured to, when the sensor detects the bubbles in the fluid during the sequential reduced pressurization of the fluid, record a pressure of the fluid when the sensor detects the bubbles, and to determine a formation pressure from the recorded pressure wherein the sensor is configured to detect the bubbles in the fluid by measuring a change in resistivity.

11. The apparatus of claim 10 wherein the formation pressure identifier is configured to:

control the pressurization module to pressurize the fluid to a second pressure;

control the pressurization module to reduce pressurization of the fluid to a third pressure;

determine whether the sensor detected the bubbles at the third pressure; and when the sensor did not detect the bubbles at the third pressure, control the pressurization module to reduce pressurization of the fluid to a fourth pressure.

12. The apparatus of claim 10 wherein the sensor is configured to detect the bubbles in the fluid by measuring a change in reflected light.

13. The apparatus of claim 10 wherein the downhole tool comprises a wireline logging tool.

14. The apparatus of claim 10 wherein the interval boundary comprises a wellbore cap, and wherein the portion of the wellbore comprises substantially all of the wellbore.

15. The apparatus of claim 10 wherein the interval boundary comprises an inflatable annular packer to define the portion of the wellbore around the downhole tool.

16. The apparatus of claim 10 wherein the interval boundary comprises a fluid sampling probe sealable against a wall of the wellbore to define the portion of the wellbore.

17. The apparatus of claim 10 wherein the pressurization module includes a hydraulic pump configured to pressurize and reduce pressurization the fluid.

18. The apparatus of claim 10 wherein the pressurization module includes a piston configured to pressurize and reduce pressurization the fluid.

19. The apparatus of claim 10 wherein the downhole tool includes the boundary interval, the pressurization module and the formation pressure identifier.

* * * * *